US007539429B2

(12) United States Patent
Shimizu

(10) Patent No.: US 7,539,429 B2
(45) Date of Patent: May 26, 2009

(54) IMAGE FORMING APPARATUS HAVING A STABLE IMAGE DENSITY

(75) Inventor: Takatoku Shimizu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 410 days.

(21) Appl. No.: 11/438,352

(22) Filed: May 23, 2006

(65) Prior Publication Data

US 2006/0269306 A1 Nov. 30, 2006

(30) Foreign Application Priority Data

May 24, 2005 (JP) ..... 2005-151345

(51) Int. Cl.
*G03G 15/00* (2006.01)
*G03G 15/02* (2006.01)
*G03G 15/043* (2006.01)
*G03G 15/06* (2006.01)

(52) U.S. Cl. ..... 399/49; 399/44; 399/46; 399/50; 399/51; 399/55

(58) Field of Classification Search ..... 399/44, 399/46, 48, 49, 50, 51, 55
See application file for complete search history.

(56) References Cited

U.S. PATENT DOCUMENTS 5,315,351 A * 5/1994 Matsushiro et al. ..... 399/49
6,125,245 A * 9/2000 Shibuya et al. ..... 399/49
6,510,293 B1 * 1/2003 Nozawa ..... 399/49 X

FOREIGN PATENT DOCUMENTS

JP 11-184190 7/1999

* cited by examiner

*Primary Examiner*—Sandra L Brase
(74) *Attorney, Agent, or Firm*—Rabin & Berdo, PC

(57) ABSTRACT

An image forming apparatus is provided capable of preventing fog from happening and obtaining more stable image density, which includes an image carrier; a charging section for charging surface of the image carrier; an exposing section for forming an electrostatic latent image on the image carrier; a developing section for making developer adhere to the electrostatic latent image formed on the image carrier so as to form a visible image; a transferring section to transfer the visible image onto a transfer member; a density detecting section to detect a density of the visible image; a development voltage setting section to set a development; a charge voltage setting section to set a difference between the charge voltage and the development into a value in a predetermined range; and an exposure quantity setting section to set an appointed exposure quantity with respect to the charge voltage.

18 Claims, 13 Drawing Sheets

| ENVIRONMENT LEVEL VALUE | 1 | 2 | 3 | 4 | 5 | 6 |
|---|---|---|---|---|---|---|
| CHARGE ENVIRONMENT TABLE VOLTAGE [V] | -580 | -640 | -700 | -760 | -820 | -880 |

*FIG. 5*

| PRINT COUNT (K SHEET) | 0≤ | 2≤ | 5≤ | 10≤ | 20≤ | 30 |
|---|---|---|---|---|---|---|
| CHARGE TEMPORALITY TABLE VOLTAGE [V] | 0 | +10 | +15 | +20 | +20 | +20 |

*FIG. 6*

| ENVIRONMENT LEVEL VALUE | 1 | 2 | 3 | 4 | 5 | 6 |
|---|---|---|---|---|---|---|
| STANDARD TABLE FOR EXPOSURE QUANTITY ADJUSTMENT [V] | -400 | -450 | -500 | -550 | -600 | -650 |

*FIG. 7*

IMAGE FORMING APPARATUS HAVING A STABLE IMAGE DENSITY

BACKGROUND OF THE PRESENT INVENTION

1. Field of the Present Invention

The present invention relates to an image forming apparatus such as printer, facsimile machine, Photocopier or MFP (Multi-Function Product) with more than two functions.

2. Related Background Art

Conventionally, image forming apparatus used in an electro photographic system charges the surface of the photosensitive drum evenly, then forms an electrostatic latent image on surface of photosensitive drum through an exposure apparatus, and then develops the electrostatic latent image on the photosensitive drum to form a toner image, finally transfers the toner image on paper through a development apparatus.

In the conventional image forming apparatus, a density of image is usually determined by a quantity of toner transferred on the paper. Nevertheless, because of such factors as the change of operating environment and frequency, there existed circumstances of change in image density. Therefore many methods aimed at prohibiting the change of image density and adjusting the image density into a target level are put forward.

For example: to charge the photosensitive drum under predetermined charge voltage circumstances, to expose with predetermined exposure quantity and to form the electrostatic latent image, to develop the toner into the electrostatic latent image with predetermined development bias voltage, and then to form the test pattern on the photosensitive drum and transfer belt and to detect the density of the test pattern through toner density detecting section. To compare the detected value with standard value, then to control the image forming circumstances such as, light quantity of exposure apparatus, development bias voltage and toner providing bias voltage, and finally to form the image density at target level on the paper.

Patent document 1 (Japanese patent publication 11-184190).

Nevertheless, with the image forming apparatus referred above, there used to exist a problem that image fog is deteriorating (non-image part is tainted).

SUMMARY OF THE INVENION

The object of the present invention is to provide an image forming apparatus that prevents the occurrence of fog and gains a more stable image density.

According to the present invention, there is a provided image forming apparatus, comprising:

an image carrier;

a charging section which is provided with a charge voltage and charges surface of the image carrier;

a exposing section for forming an electrostatic latent image on the surface of the image carrier)

a developing section which is provided with a development voltage and makes developer adhere to the electrostatic latent image formed on the image carrier so as to form a visible image;

a transferring section to transfer the visible image onto a transfer member;

a density detecting section to detect a density of the visible image on the transfer member;

a development voltage setting section to set a development voltage to be provided to the developing section through the density detected by the density detecting section;

a charge voltage setting section to set a difference between the charge voltage provided to the charging section and the development voltage set by the development voltage setting section into a value in a predetermined range; and an exposure quantity setting section to set an appointed exposure quantity with respect to the charge voltage.

Moreover, the image forming apparatus may further comprise an environment information detecting section to detect environment information in the image forming apparatus; and an environment table to memorize voltage according to the detected environment information, wherein according to the detected print information, a difference between the charge voltage provided to the charging section and the development voltage set by the development voltage setting section is set into a value in predetermined range.

Moreover, in the image forming apparatus, the environment information may be either of temperature and humidity in the image forming apparatus.

Moreover, the image forming apparatus may further comprise a print information detecting section to detect print information; and a temporality setting table to memorize voltage according to the detected print information, wherein according to the detected environment information, a difference between the charge voltage provided to the charging section and the development voltage set by the development voltage setting section is set into a value in predetermined range.

Moreover, in the image forming apparatus, the print information may be the number of print sheets.

Further, according to the present invention, there is a provided image forming apparatus, comprising:

an image carrier;

a charging section which is provided with a charge voltage and charges surface of the image carrier;

an exposing section for forming an electrostatic latent image on the surface of the image carrier;

a developing section which is provided with a development voltage and makes developer adhere to the electrostatic latent image formed on the image carrier so as to form a visible image;

a transferring section to transfer the visible image onto a transfer member;

a density detecting section to detect a density of the visible image on the transfer member;

a development voltage setting section to set a development voltage to be provided to the developing section through the density detected by the density detecting section;

a potential detecting section to detect surface voltage of the visible image;

a charge voltage setting section to set a difference between the charge voltage provided to the charging section and the development voltage set by the development voltage setting section into a value in a predetermined range on the basis of the surface voltage detected by the potential detecting section; and an exposure quantity setting section to set an appointed exposure quantity with respect to the charge voltage.

Moreover, in the image forming apparatus, the potential detecting section may be to detect a visible image potential on the image carrier.

Moreover, in the image forming apparatus, the potential detecting section may be to detect a visible image potential on the transfer member.

Moreover, in the image forming apparatus, the potential detecting section may be to detect a visible image potential on the developing section.

Moreover, in the image forming apparatus, the potential detecting section is a potential sensor.

Moreover, in the image forming apparatus, the potential detecting section may be a development electric current detecting circuit.

According to the present invention, the provided image forming apparatus has: image carrier; charging section which provides charge voltage and charges the surface of referred image carrier; exposing section which forms the electrostatic latent image on the surface of referred image carrier; developing section which provides development voltage and makes the developer adhere to the formed electrostatic latent image on the referred image carrier; transferring section which transfers the referred visible image on the transferring components; density detecting section which detects the density of referred visible image on the transferring components; development voltage setting section which sets the developing voltage provided to the referred developing section through the detected density from the referred density detecting section; charging voltage setting section which sets the potential difference within predetermined range between charging voltage that provides for referred charging section and the referred predetermined developing voltage; exposure quantity section which sets the referred predetermined charging voltage and exposure quantity. Therefore, outputting images with a stable density and good quality but out of fog could be gained.

Additionally, according to the present invention, the provided image forming apparatus has: image carrier; charging section which provides charge voltage and charge the surface of referred image carrier; exposure section which forms the electrostatic latent image on the surface of referred image carrier; developing section which provides development voltage and makes the developer adhere to the formed electrostatic latent image on the referred image carrier; transferring section which transfers the referred visible image on the transferring components; density detecting section which detects the density of referred visible image on the transferring components; development voltage setting section which sets the developing voltage provided to the referred developing section through the detected density from the referred density detecting section; charging voltage setting section which sets the potential difference within predetermined range between charging voltage that provides for referred charging section and the referred predetermined developing voltage; exposure quantity section which sets the referred predetermined charging voltage and exposure quantity. Therefore, outputting images with a stable density and good quality but out of fog could be gained.

The above and other objects and features of the present invention will become apparent from the following detailed description and the appended claims with reference to the accompanying drawings.

BRIEF DESCRIPTION OF THE DRAWINGS

FIG. 5 is a chart showing charge environment table voltage corresponding to environment level according to embodiment 1 of the present invention;

FIG. 6 is a chart showing charge temporality table voltage with respect to print count according to the present invention;

FIG. 7 is a chart showing exposure quantity adjustment standard table voltage with respect to environment level according to the present invention;

DETAILED DESCRIPTION OF THE PREFERRED EMBODIMENTS

For the purpose of describing the present invention, two embodiments are explained with reference to the drawings. The preferred range of the present invention is not limited to these embodiments. Based on the purpose of the present invention, various changes to the preferred embodiments could be made.

In these situations, the relation between the changes of non-image section contrast voltage and fog is specified. As far as non-image section contrast voltage is concerned, it is the absolute value for the difference between the result of adding development bias voltage to toner layer potential and the photosensitive drum charge potential. Furthermore, development contrast voltage is the absolute value for the difference between the result of adding the development bias voltage to the toner layer potential and the latent image potential of exposure section.

Figure 4:
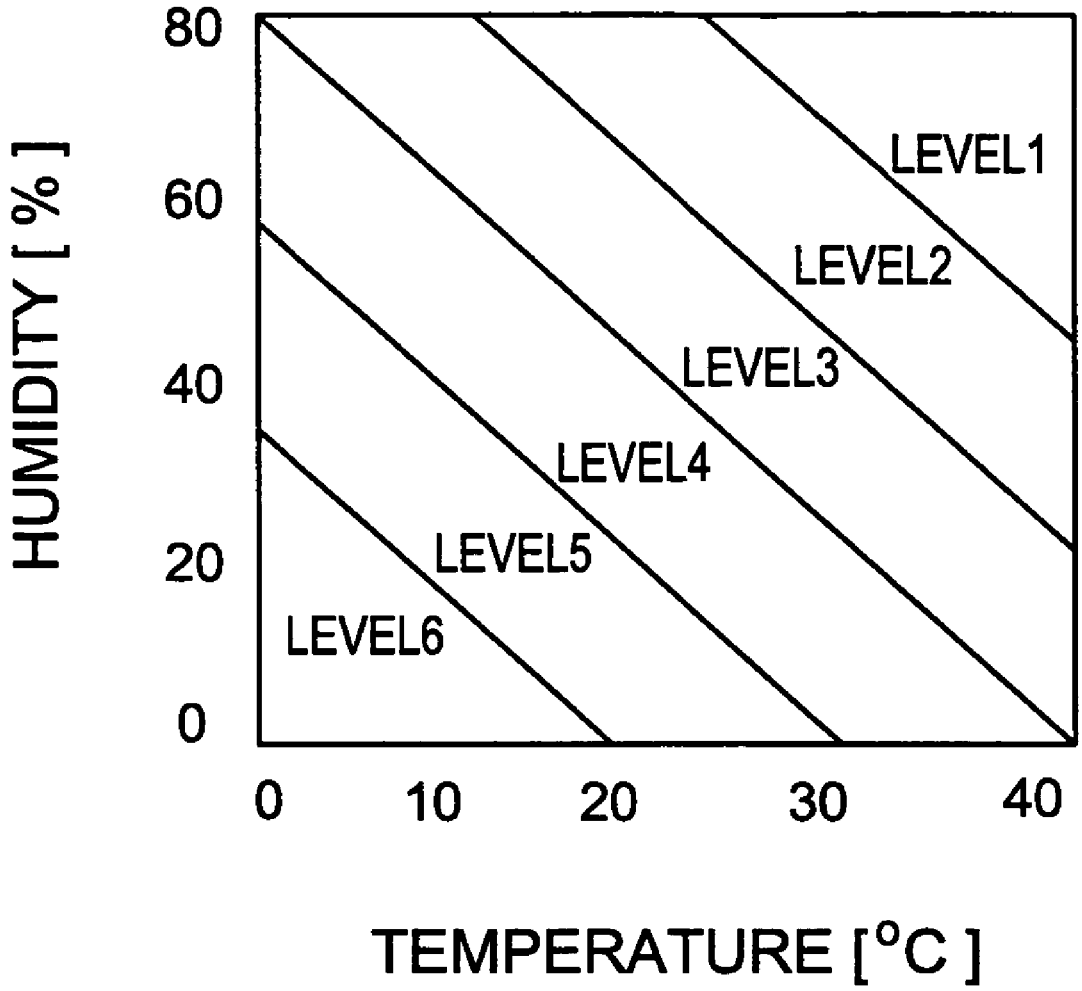
FIG. 4 is a environment level chart that shows in stages the image forming characteristics according to temperature and humidity of the present invention.

First of all, an environment level value, a charge environment table voltage and a charge temporality table voltage are described. All the environment levels are a kind of changing level showing stepwisely the image forming features corresponding to temperature and humidity. It is calculated according to the relation between temperature and humidity detected by environment sensors with reference to the calculating section. Fig 4 is an environment level chart stepwisely showing the image forming characteristics according to temperature and humidity in the present invention. For example, high temperature and humidity environment of 30 degree C. and 80% humidity is known as level 1; the indoor environment of 25 degree C. and 45% humidity is known as level 3; the low temperature and humidity environment of 10 degree C. and 10% humidity is known as level 6.

As described in FIG. 5, charge environment table voltage is an amendment voltage set within the charge environment table and used in different operation environments. As described later in the text, the charge environment voltage is predetermined corresponding to various operation environments of the image forming apparatus for the purpose of changing the non-image section contrast voltage value into predetermined range. Charge temporality table voltage is set within the charge temporality table, that is, a kind of voltage based on the changing features of toner layer potential of print count showed in FIG. 12 and used to predetermine the changing quantity of toner potential showed in FIG. 6 as well. For example, when the environment level value is 3, print count is 2000 and charge environment table voltage is −700V (FIG. 5), the charge temporality table voltage value is +10V (FIG. 6).

(1) To describe the deteriorating tendency concerning with fog with reference of the increase of non-image section contrast voltage.

In this situation, the deteriorating tendency concerning with fog with reference of the increase of non-image section contrast voltage is described when the image forming apparatus is on the same operation environment level.

Figure 8:
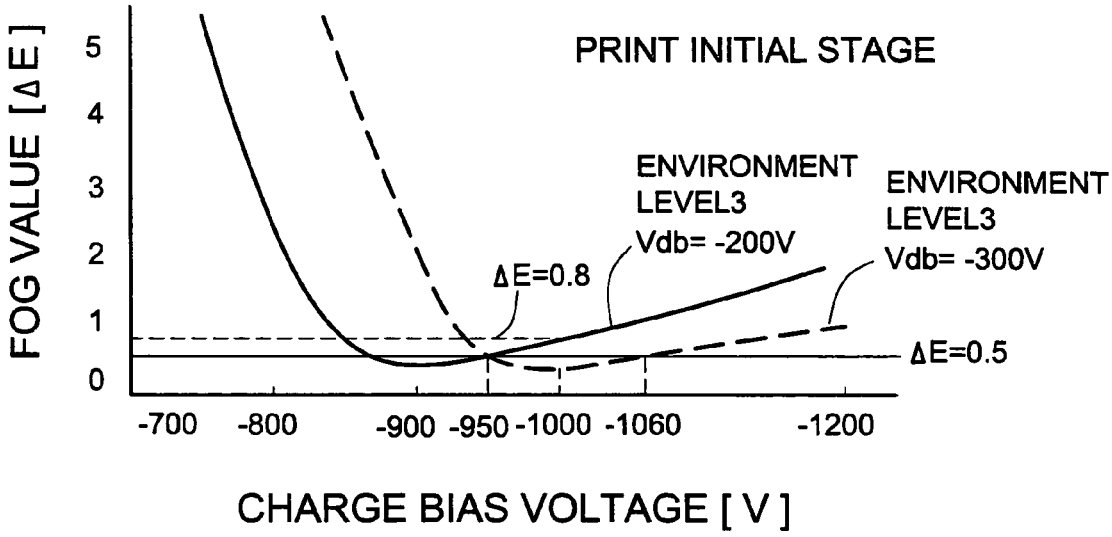
FIG. 8 is a diagram showing a relation between charge bias voltage and fog degree when the environment level is 3 and development bias voltage (V db) is −200V and is −300V at print initial stage.
Figure 10:
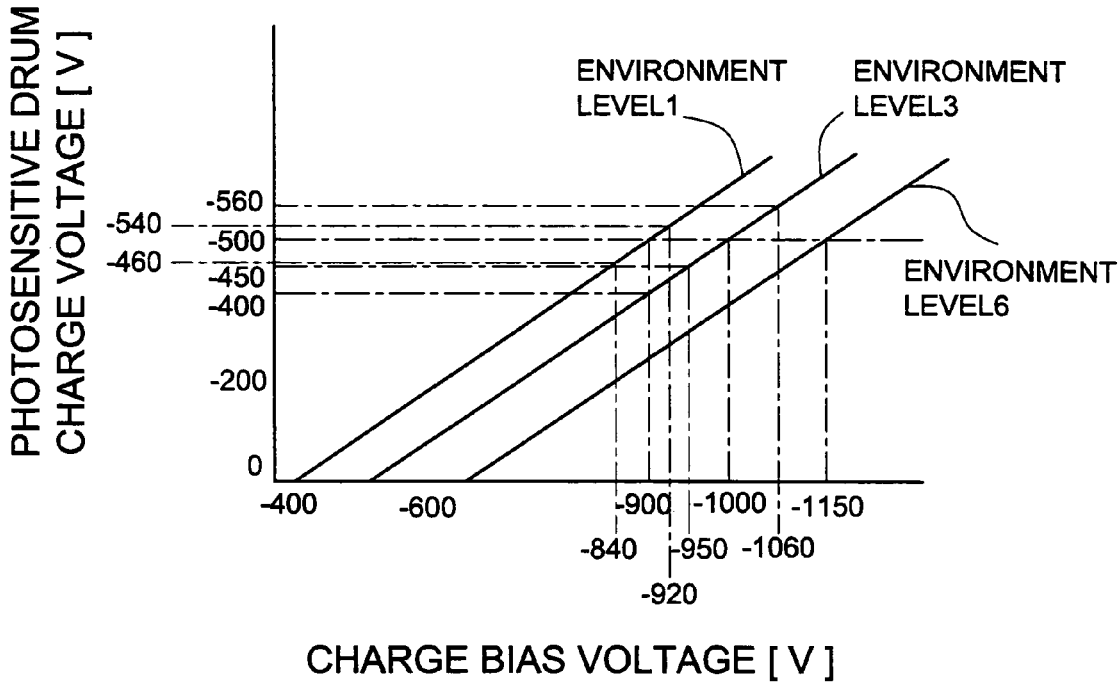
FIG. 10 is a diagram showing a relation between charge bias voltage provided to charging roller and charge potential on surface of photosensitive drum according to respective environment levels.
Figure 11:
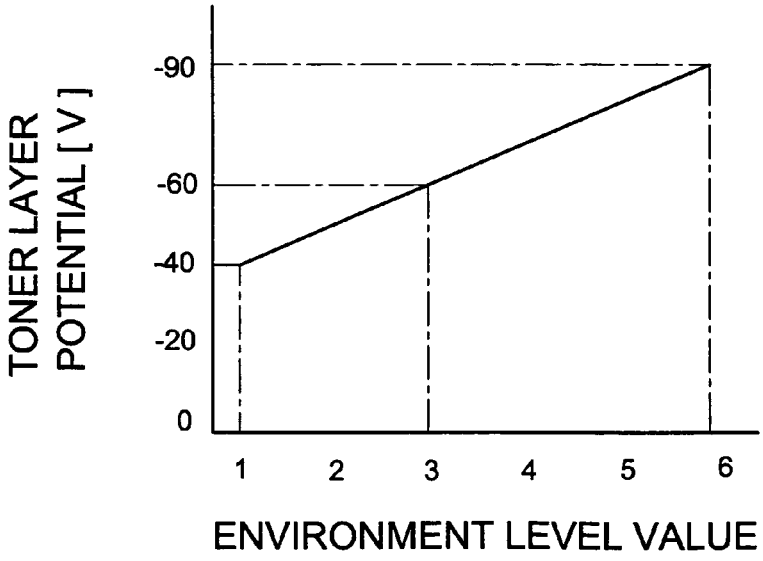
FIG. 11 is a diagram showing a relation between toner layer potential and environment level.
Figure 12:
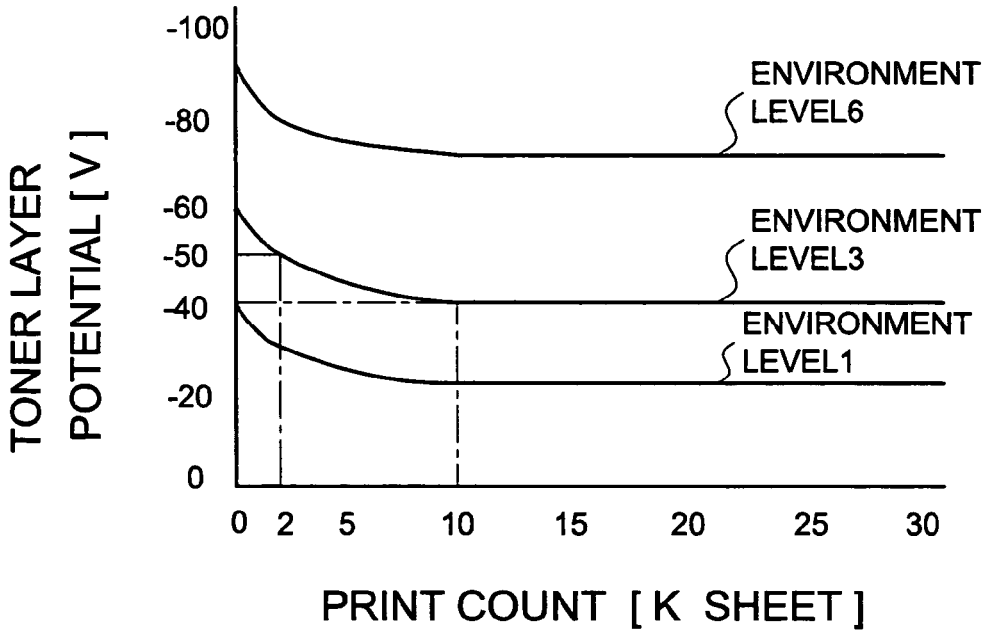
FIG. 12 is a diagram showing a change relation between print count and toner layer potential according to respective environment levels.

FIG. 8 is a diagram showing the relation between charge bias voltage and fog degree when the environment level is 3 and development bias voltage (V db) is −200V and −300V at print initial stage. Fog value on the longitudinal axis is showed by the aberration that displays the density index of fog, the bigger the value is the more the image is fogged. As target value, the fog value is set under level 0.5 which could not be identified by eyes corresponding to the color blotch of non-image section on the print medium. FIG. 10 is a diagram showing the relation between charge bias voltage that provides for charging roller and charge potential on the surface of photosensitive drum on different environment levels. Regardless of different situations of environment levels, the increasing gradients of the photosensitive drum charge potential are the same with reference to charge bias voltage. Nonetheless, the smaller the showing environment level value is the higher the photosensitive drum charge potential (absolute value) is (when the charge potential of photosensitive drum is −500V and the environment level is 1, providing charge bias voltage is −900V), when the environment level is 3, the charge bias voltage is −1000V, environment level 6, −1150V). FIG. 11 is a diagram showing the relation between toner layer potential and environment levels. As showed in FIG. 11, with the change of environment level from 1 to 6, the toner layer potential increases from −40 V to −90 V. FIG. 12 is a diagram showing the change relation between print count and toner layer potential on different environment levels. For example, as showed in FIG. 12, when the environment level is 3, the toner layer potential is −60 V at the initial stage. Nevertheless, the toner layer potential declines as the count value goes down until the print count reaches the quantity of 10000. The toner layer potential keeps as −40 V when the print quantity exceeds 10000 sheets.

Firstly, if the charge bias voltage is predetermined as −1000V and environment level as 3, when the development bias voltage V db=−300V and V db=−200V, the changing tendency of non-image section contrast voltage is observed. Under this situation, since the charge bias voltage is −1000V, the charge potential of photosensitive drum is −500V according to FIG. 10. In addition, with reference of FIGS. 11 and 12, the toner layer potential is −60 V (at the initial print stage, that is, print count is 0). Based on them, the absolute value (non-image section contrast voltage)for the difference between the sum corresponding to development bias voltage with toner layer potential and the photosensitive drum charge potential is: when V db=−200V, |−200+−(60)−(−500)|=240V; when V db=−300V, |−300+(−60)−(−500)=140V.

Nevertheless, in FIG. 8, when charge bias voltage is predetermined as −1000V, V db=−300V, the fog value is below 0.5 which turned out to be good. By contrast, when V db=−200V, the fog value changed into 0.8 which turned out to be poor. In other words, when non-image section contrast voltage increase from 140V to 240V, the fog value changed from good condition under 0.5 to poor condition of 0.8. That is, the increase of non-image section contrast voltage led to the tendency of fog deteriorating. Actually, in FIG. 8, with regards to the curve of V db=−300 V, the good condition of fog value should be between the range of −950 V to −1060, as a result, the range of non-image section contrast voltage can be calculated. When the charge bias voltage is known as −950 V and −1060 V, the corresponding photosensitive drum charge potential is −450 V and −560 V. It can be referred that the non-image section contrast voltage increases from |−300+(−60)−(−450)−=90V to |−300+(−60)−(−560)|=200V.

(2) The deteriorating tendency concerning fog is described through the decrease non-image section contrast voltage.

In this situation, to describe the deteriorating tendency concerning fog through the decrease non-image section contrast voltage when the image forming apparatus is under different environment levels.

Figure 9:
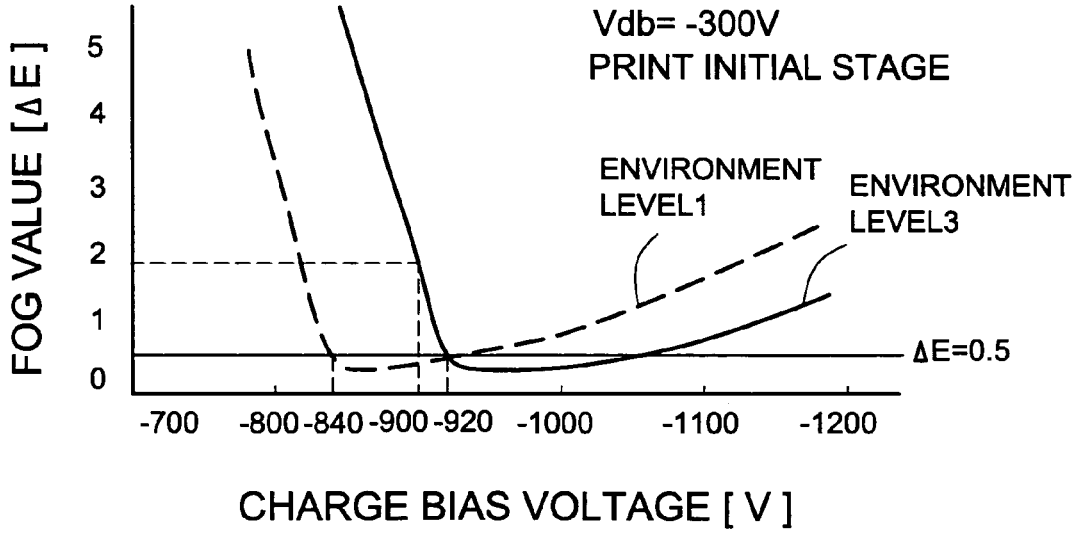
FIG. 9 is a diagram showing a relation between charge bias voltage and fog degree when development bias voltage (V db) is −300V and environment level is 1 and 3 at print initial stage.

FIG. 9 is a diagram showing the relation between charge bias voltage and fog degree when development bias voltage (V db) is −300V and the environment level is 1 and 3 at print initial stage. Firstly, when the charge bias voltage is set as −900V, the changing tendency of the non-image section contrast voltage for environment levels 1 and 3 is observed. In this situation, when the environment level is 1, the photosensitive drum charge voltage is −500V; when the environment level is 3, the photosensitive drum charge voltage is −400V. In addition, according to the FIG. 11 and FIG. 12 (print initial stage, that is, print count is 0), the toner layer potential is −40V when the environment level is 1; and the toner layer potential is −60V when the environment level is 3. According to them, when the environment level is 1, the non-image section contrast voltage is |−300+(−40)−(−500)|=160V; when the environment level is 3, |−300+(−60)−(−400)|=40V.

Nevertheless, according to FIG. 9, when charge bias voltage is predetermined as −900V, environment level is 1; the fog value is below 0.5 that turned out to be good. By contrast, when the environment level is 3, the fog value is 2.0 that turned out to be poor. In other words, when the non-image section contrast voltage decreases from 160 V to 40 V, fog value change from good condition under 0.5 to deteriorating poor condition of 2.0. That is, the decrease of non-image section contrast voltage leads to the tendency of fog deteriorating. Actually, in FIG. 9, with regards to the curve of environment level 1, the good condition of charge bias voltage should be between the range of −840 V to −920, as a result, the range of non-image section contrast voltage can be calculated. When the charge bias voltage is known as −840 V and −920 V, the corresponding photosensitive drum charge potential is −460 V and −540 V according to FIG. 10. It can be referred that the non-image section contrast voltage increases from $|-300+(-60)-(-460)|=100V$ to $|-300+(-60)-(-540)=180V$.

Figure 15:
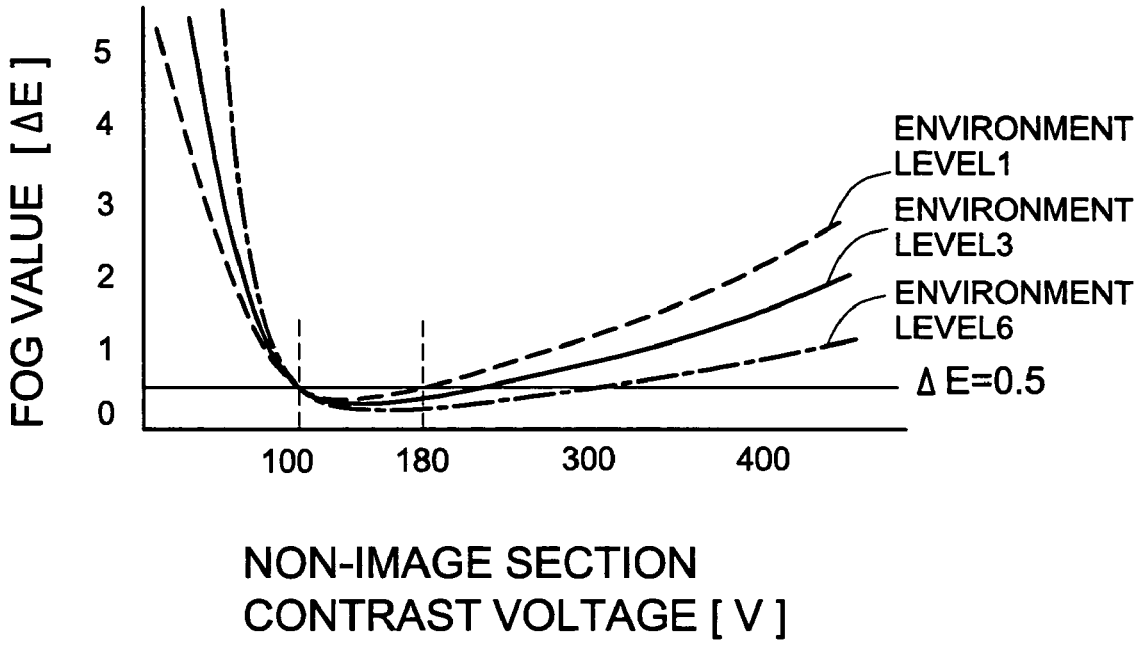
FIG. 15 is a diagram showing a change relation between non-image section contrast voltage and fog degree.

As referred above, good condition of the non-image section contrast voltage slightly changes according to the change of environment. When the non-image section contrast voltage is above 180V, among the charging distributions of toner, the non-image section contrast voltage makes the charge toner adhere to the photosensitive drum with reversed direction of potential and poor fog value above 0.5. On the contrast, when the non-image section contrast voltage is under 100V, among the charging distributions of toner, the toner with high voltage could also easily be developed on non-image section and the fog value changes into poor condition above 0.5. FIG. 15 is a diagram showing the change relation between non-image section contrast voltage and fog degree. According to the drawings, among different operation environments, if the non-image section contrast voltage value is controlled within the range of 100V-180V and fog value is under 0.5, the fine image quality can be gained.

Therefore, based on (1) and (2) referred above, if the non-image section contrast voltage changes, the changing tendency of fog can be known. Conventionally, development contrast voltage is adjusted for amendment density, while if the development contrast voltage is adjusted, there will be reasons existed for the happening of fog value deterioration. Therefore, the feature of the present invention is to regard the non-image section contrast voltage as a predetermined value that is used to control bias conditions. (The range value is 100 V to 180 V according to FIG. 15). Furthermore, the exposure quantity is adjusted according to the change of charge bias voltage in order to prevent the happening of fog. As a result, a more stable image density can be gained. Two embodiments are explained.

Embodiment 1

Among the different operation environments of image forming apparatus for the present embodiment, environment voltage table is set for purpose of making the non-image section contrast voltage into predetermined value range. Furthermore, the present embodiment is an example of image density amendment in which the image density changes according to the characteristic changes of such factors as actual operation environment, print count, operation frequency, print image area rate or the image forming process material. The non-image section contrast voltage makes the fog value being voltage value under 0.5 under different operation environments. The present embodiment is composed of two great parts, say, (1) and (2). (1) Firstly, in order to make the non-image section contrast voltage become the value within the predetermined range (here with a range of 100V-180V), the voltage value is set in the charge environment table and makes the image forming apparatus work with gained bias conditions. The most desirable result: to make the non-image section contrast voltage value into predetermined range under different environments, to set the voltage value in the charge environment table and to engage in bias control. And the target image density is gained by adjusting exposure quantity according to the change of charge bias voltage. Nevertheless, out of different actual factors described above, the image density would change even with the same bias condition. (2) In this situation, the image density is detected. When the density changes, control bias conditions amend the image density to reach the target density.

Figure 1:
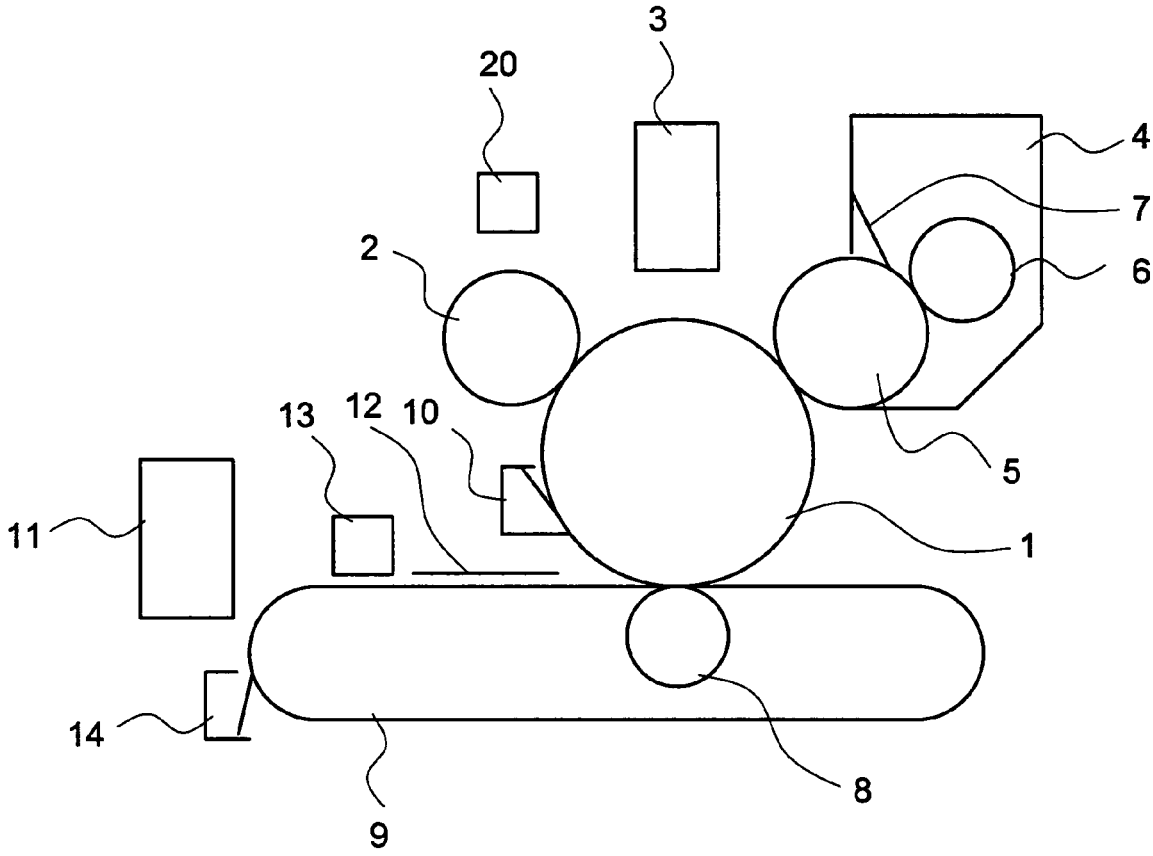
FIG. 1 is a diagram of an image forming apparatus according to embodiment 1 of the present invention.

FIG. 1 is a diagram of an image forming apparatus according to embodiment 1 of the present invention. In this case, the image forming apparatus is a printer of electronic photographic. In the image forming apparatus, a photoconductor layer is formed on a drum-like conductor's surface made of aluminum so as to form a photosensitive drum 1 as an image carrier by revolvingly driven. In circumference of the photosensitive drum 1, a charging roller 2; an exposure head 3; a developing machine 4; a transfer belt 9; a photosensitive drum cleaning blade 10; a fixing machine 11 and a density sensor 13 are equipped.

The charging roller 2 is an electroconductive elastic body made of conductors such as stainless steel with its axis wrapped with epichlorohydrin outside. It is installed at the position attaching to the photosensitive drum.

The exposure head 3, for example, is composed of LED components and lens array. It is equipped at the position where the shining light came out of the LED components which form image on the surface of the photosensitive drum.

The developing machine 4 is composed of developing roller 5, providing roller 6, and adjustment blade 7. The developing roller 5 is an electroconductive elastic body made of conductors such as stainless steel with its axis wrapped with urethane outside. The providing roller 6 is an elastic body of foam-ability made of conductors such as stainless steel with its axis wrapped with silicone outside. The adjustment blade 7 is made of tabular material such as stainless steel. Internally, there also existed toner cartridge that provides toner while not displayed on drawings. The developing roller 5 is installed at the position attached to photosensitive drum 1.

The transfer belt 9 is made of banding material of semiconductor such as polyamide and is installed at the position attached to photosensitive drum 1. At the position attached to photosensitive drum 1, a transfer roller 8 made of elastic body of formability is installed at its corresponding position. The density sensor 13 is a photo sensor composed of illuminating and light receiving diode. It is installed at the backward position between transfer belt 9 and photosensitive drum 1. At the backward position of density sensor 13, the transfer cleaning blade 14 is installed at the position attached to transfer belt. 12 is used to denote the print medium transmit on transfer belt 9. In addition, the environment sensor 20 is included in the image forming apparatus to detect temperature and humidity of such apparatus.

In such print process of this printer, it initially provides charge bias voltage for charging roller 2 and charges the surface of photosensitive drum 1 evenly. Then, it provides driving current for exposure head 3 and exposes the surface of charged photosensitive drum 1 that leads to the formation of desired electrostatic latent image pattern. Then, the development bias voltage is provided to developing roller 5 that forms the toner thin layer on the surface. After the toner on photosensitive drum 1 is transferred on medium 12, the toner image of print medium 12 is fixed on print medium 12 through fixing machine. It is the end of print operation.

Figure 2:
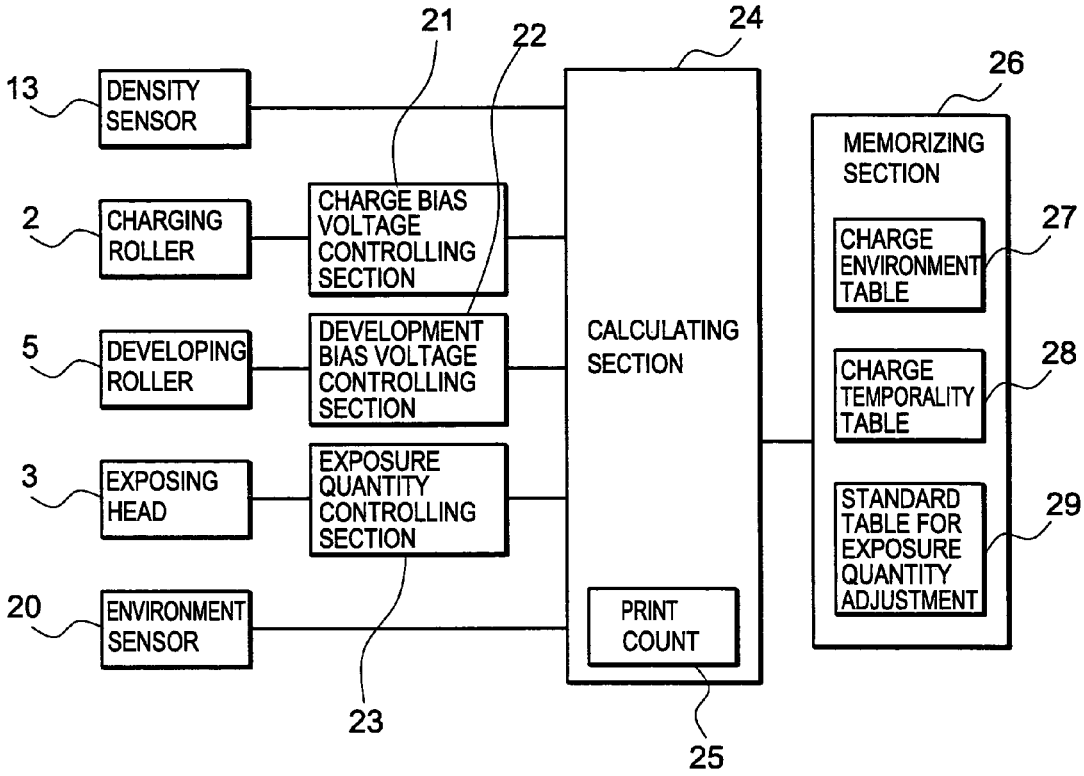
FIG. 2 is a control block diagram of an image forming apparatus according to embodiment 1 of the present invention.

FIG. 2 is a controlling block diagram of an image forming apparatus according to embodiment 1 of the present invention; Charge bias voltage controlling section 21 is connected to charging roller 2 and provides it with charge bias voltage set by calculation section 24. Development bias voltage controlling section 22 is connected to developing roller 5 and provides it with development bias voltage set by calculation section 24. Exposure quantity controlling section 23 is connected to exposure head 3 and provides it driving current value set by calculating section 24. Density sensor 13 detects the toner image on transfer belt 9. The output value is the detected density calculated by calculating section 24.

Environment sensor 20 detects the internal temperature and humidity of the apparatus. The output value is known as the detected environment level value calculated by the calculation section 24. A print count section 25 is installed in the calculating section 24 to detect the rolling count for photosensitive drum 1 and calculates the count value corresponding to print count by calculation. In addition, memorizing section 26 is connected to the calculating section 24. Within the inner part of memorizing section 26, the charge environment table 27 including voltage value corresponding to environment level value is installed; charge temporality table controlling section 28 memorizing voltage value corresponding to print count; in addition, exposure adjustment standard table 29 memorizing voltage value corresponding to environment level value.

Figure 3:
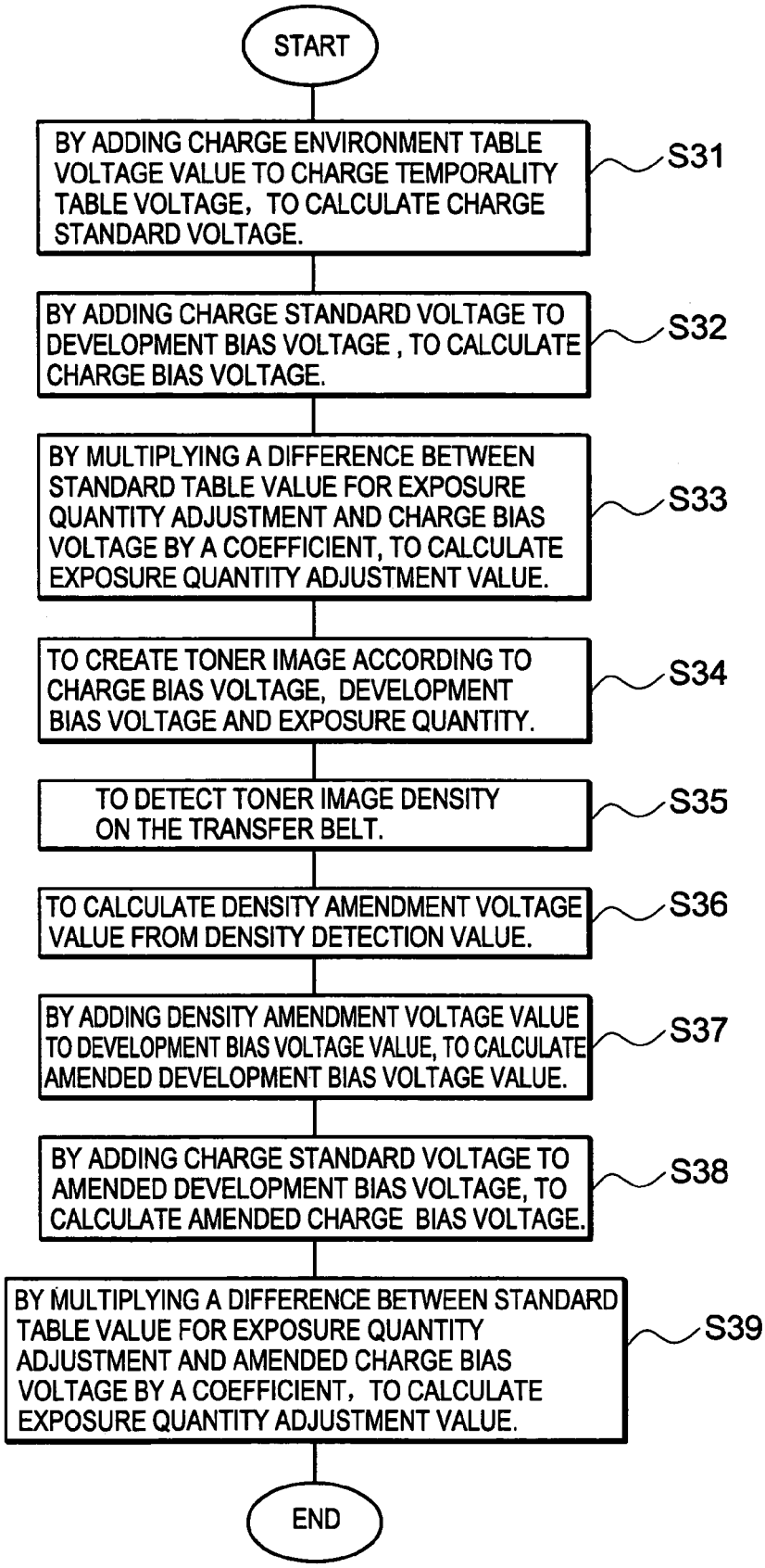
FIG. 3 is a flowchart of density amendment according to embodiment 1 of the present invention.

FIG. 3 is a flowchart of density amendment according to embodiment 1 of the present invention; Firstly, from the charge environment table 27 memorized by memorizing section 26, the charge environment table voltage value is read corresponding to environment level value. From the charge temporality table voltage value controlling section 28 memorized by the same memorizing section 26, the charge temporality table voltage value is read corresponding to the print count value. Then, by adding the charge environment table voltage value to the charge temporality table voltage value to calculate charge standard voltage. The charge environment table voltage value sets the non-image section contrast voltage value (100V to 180V) (step S31) within predetermined range under different operation environment levels. Then, by adding the calculated charge standard voltage to development contrast voltage to calculate charge anti-bias voltage (step S32). Then, to read the exposure quantity adjustment environment table voltage value corresponding to environment levels from the exposure quantity adjustment environment table 29 memorized in memorizing section 26, as referred above, to calculate the difference between calculated charge bias voltage. By multiplying the difference value with adjustment coefficient, to calculate exposure quantity adjustment value (step S33). As referred above, the toner image is created on the photosensitive drum according to the appointed charge bias voltage, development bias voltage and exposure quantity. Toner image is related to the position of density sensor 13, for example: if the patch patterns with image area rate of 100%, 70%, and 30% is acceptable (step S34). The formed toner image is directly transferred on the transfer belt, then when the patch pattern moves below the density sensor 13, the reflectivity of patch pattern is read through the rolling of transfer belt 9 which is used for calculation in the calculating section 24 to detect image density (step S35). The difference between detected density value and target value is calculated after the calculation of image density in the calculating section 24. When a linear relation is kept between development bias voltage value and density, the amended voltage value of development bias voltage corresponding to amended difference density is calculated according to the amended coefficient memorized in memorization section 26 in advance. (Step S36). By adding the amended value of development bias voltage to development bias voltage value according to the density calculated above to calculate the amended development bias voltage (step S37). By adding the charge standard voltage to the amended development bias voltage after the amended development bias voltage is calculated to calculate the amended charge bias voltage (step S38). By multiplying the difference between exposure quantity adjustment table value and amended charge bias voltage with adjustment coefficient after the amended charge bias voltage is calculated to calculate the exposure quantity adjustment value (step S39). This flow procedure is completed after the exposure quantity is adjusted.

To specify the present embodiment with concrete examples of figure according to the flow of the present embodiment as following.

Figure 13:
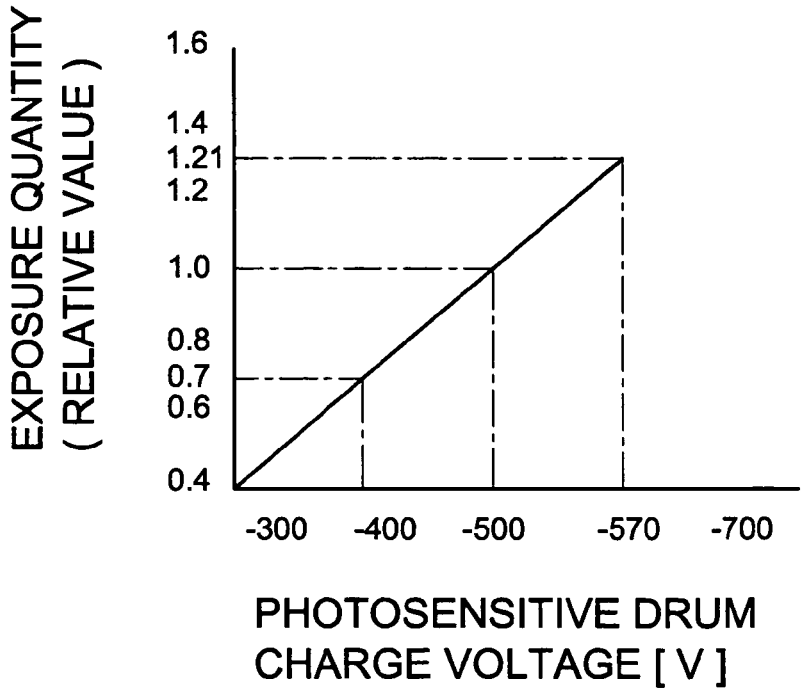
FIG. 13 is a diagram showing a relation between charge potential of photosensitive drum and setting value of exposure quantity.
Figure 14A:
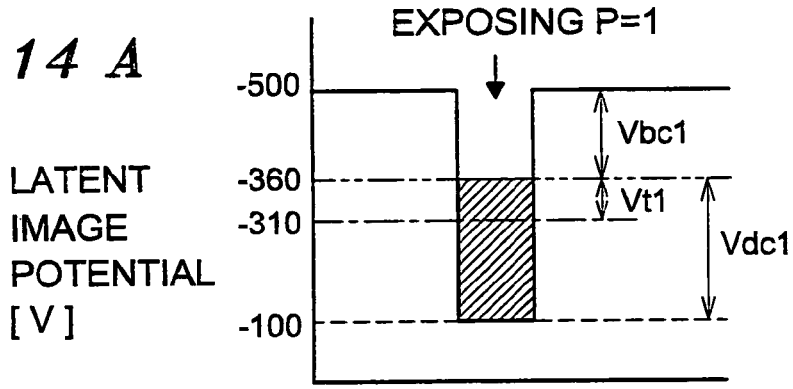
FIG. 14A is a first chart illustrating the embodiment 1 of the present invention through the change of latent image potential.

In this case, the environment level value of image forming apparatus is 3, print count 2000. FIG. 5 is a chart showing charge environment table voltage corresponding to environment level according to embodiment 1 of this invention. FIG. 6 is a chart showing charge temporality table voltage corresponding to print count according to embodiment 1 of this invention. According to FIG. 5 and FIG. 6, when the print count is 2000, the charge environment table voltage value is −700V. Since the charge temporality table voltage value is with +10V of read in voltage value, charge standard voltage is (−700+10)=−690V (step S31). In this situation, the development bias voltage is −310V. Therefore, the charge bias voltage is (−690V)+(−310V)=−1000V (step S32). To specify with FIG. 13 when the exposure quantity adjustment is turned off. FIG. 13 is a diagram showing the relation between the charge potential of photosensitive drum and the setting value of exposure quantity. Taking the exposure quantity when the photosensitive drum charge potential is −500V as exposure standard value, the exposure quantity in proportion to the change of the photosensitive drum charge potential is adjusted. For example, within the exposure standard value, if the driving current is 3 mA, when the photosensitive drum charge potential is −400V, the exposure quantity is adjusted to 0.7 (relative value) according to FIG. 13. Simultaneously, if the driving current is 3 mA×0.7=2.1 mA which is good. According to FIG. 7, since the exposure quantity adjustment standard voltage is −500V when the environment level is 3, the charge bias voltage being −1000V as described before, the difference is changed into −500V. The exposure quantity is calculated as 1.0 according to FIG. 13. (step S33). It can be referred from above that the toner layer image is created on photosensitive drum according to the decided charge bias voltage (−1000V), development bias voltage (−310V) and exposure quantity (P=1.0). (Step S34). In this situation, the latent image potential is described with FIG. 14A. The latent image potential of exposure section is 100V when the photosensitive drum charge potential is −500V and exposure quantity is (P=1.0). The development bias voltage is described as −310V and the toner layer potential Vt1 is −50V according to FIG. 12 (print count is 2000). According to all the figures, the development contrast voltage is |−310+(−50)−(−100)|=260V. Non-image section contrast voltage Vdc is −310+(−50)−(−500)|=140V. According to FIG. 15, fog value is 0.5 that proved to be good.

Figure 14B:
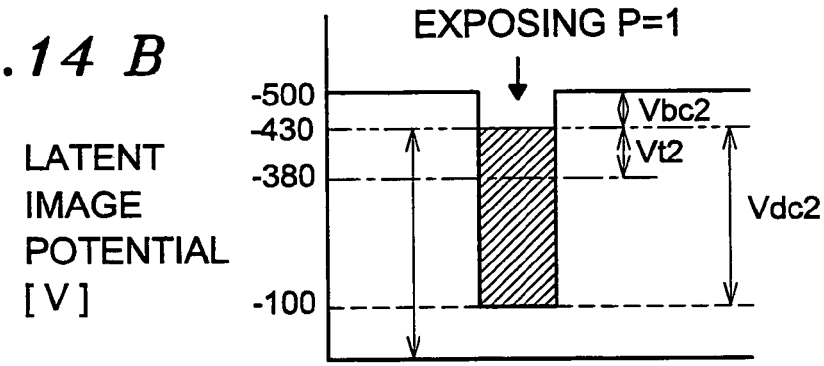
FIG. 14B is a second chart illustrating the embodiment 1 of the present invention through the change of latent image potential.
Figure 14C:
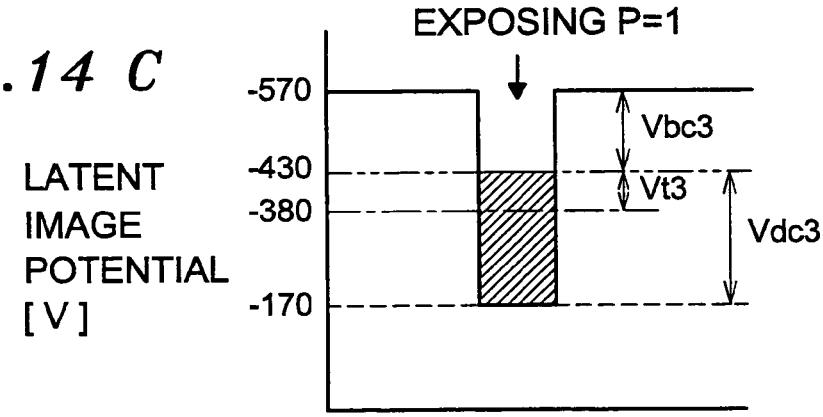
FIG. 14C is a third chart-illustrating the embodiment 1 of the present invention through the change of latent image potential.
Figure 14D:
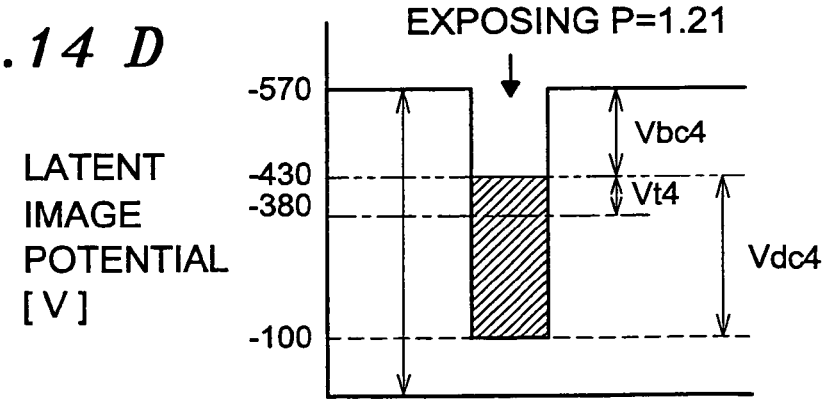
FIG. 14D is a fourth chart illustrating the embodiment 1 of the present invention through the change of latent image potential.

Later, the density is detected. In this situation, the detected density OD (Optical Density) is 1.29 and the target density OD is 1.5. (Step S35). In terms of the charge characteristics of developing roller material and toner in the present embodiment, since the amended coefficient is 0.3 corresponding to the OD changing quantity when the changing quantity of development bias voltage is 100V, the development bias voltage is increased (1.29−1.5)*100)/0.3=−70V which proved to good. Therefore, the amended value of development bias voltage corresponding to the current density is −70V (Step S36). Since the development bias voltage is −310V, the amended development bias voltage is (−70)+(−310)−380V. (Step S37). For the sake of reference, latent image potential on the photosensitive drum under the referred bias conditions is showed on FIG. 14B. When the development bias voltage is changed into −380V, development contrast potential Vdc2 is |−380+(−50)−(−100)|=330V. Compared with that of un-amended situation, the latent image potential is increased |Vdc2−Vdc1|=70V. On one hand, non-image section contrast voltage Vdc2 is |−380+(−50)−(−500)|=70V, fog is above the range of 0.5 which proved to be not good as showed in FIG. 15. Since the charge standard voltage is −690V, the amended development bias voltage is −380V and the amended charge bias voltage is (−690)+(−380)=−1070V (Step S38). The latent image potential on the photosensitive drum referred in FIG. 14C, since the charge potential of photosensitive drum is increased, the all the latent image potential are increased to −70V. Therefore, the non-image section contrast voltage Vdc3 is |−380+(−50)−(−570)|=140V, according to FIG. 15, the fog is below the range of 0.5 that proved to be good. On the other hand, the amended density gained after the development contrast voltage Vdc3 is decreased |−380+(−50)−(−170)|=260V. The exposure quantity must be adjusted before the amended density is gained. As referred above, exposure quantity adjustment standard table value is −500V, the amended charge bias voltage is −1070V, the difference is −570V. According to FIG. 13, when the photosensitive drum charge potential is −570V, the amended value of exposure quantity is 1.21. (Step S39). As shown by FIG. 14D, the depth of latent image potential is increased by 70V. Therefore, the non-image section contrast voltage Vdc4 is kept as 140V; furthermore since the development contrast voltage Vdc4 is 330V, the latent image potential of exposure section is −100V, as a result the target density is 1.5.

According to the above processing, the bias control is completed through the density amendment of the present embodiment. According to the density amendment of the present embodiment, the non-image section contrast voltage is usually within the predetermined range under the circumstances of change of development bias voltage and operation environments. For example, at the print initial stage, the non-image section contrast voltage is 140V. Therefore, as showed in FIG. 15, good print quality with fog value below 0.5 can be gained under all environment levels. If the fog value below 0.5 is regarded as target, the setting value of non-image section contrast voltage is good as long as being within the range of 100V and 180V. In addition, for the purpose of setting the non-image section contrast voltage within predetermined range, when the charge bias voltage is changed, a certain degree of density could be reached since the exposure quantity is adjusted according to that changing quantity and the development contrast voltage is kept as the amended density value.

Within the present embodiment, the way of adjustment of driving current related to exposure quantity is specified. Nevertheless, since the exposure quantity is proportion to radiation quantity and radiation time corresponding to driving current, the radiation time also can be adjusted when the driving current is at a certain level.

The density amendment as referred above can be performed when the power of the apparatus is turned on, print count is defined into a certain amount or the environment level is changed.

Certainly, the value showed in the present embodiment is only one example that meets the conditions for characteristics of usage craft materials and craftwork speed. The table voltage value is set into most suitable one that turned out to be good.

Embodiment 2

The present embodiment is an example in which the photosensitive drum charge potential and toner layer potential are directly detected. The non-image section contrast voltage value is set into predetermined range (here is 100V-180V) to adjust the density through the adjustment of the non-image section contrast voltage in different operation environments of image forming apparatus.

In the present embodiment, there exists two great frames, that is, (1) firstly, the image density of image apparatus with operation is detected and the difference between target density value and it is calculated. The bias voltage condition is amended according to the density value difference. (2) Secondly, the standard bias voltage is calculated when the non-image section contrast voltage value is regarded as target non-image section contrast voltage value under amended bias voltage, then the target density is gained according to the adjustment of exposure quantity.

In the present embodiment, the target non-image section is below 0.5 in different operation environment.

Figure 16:
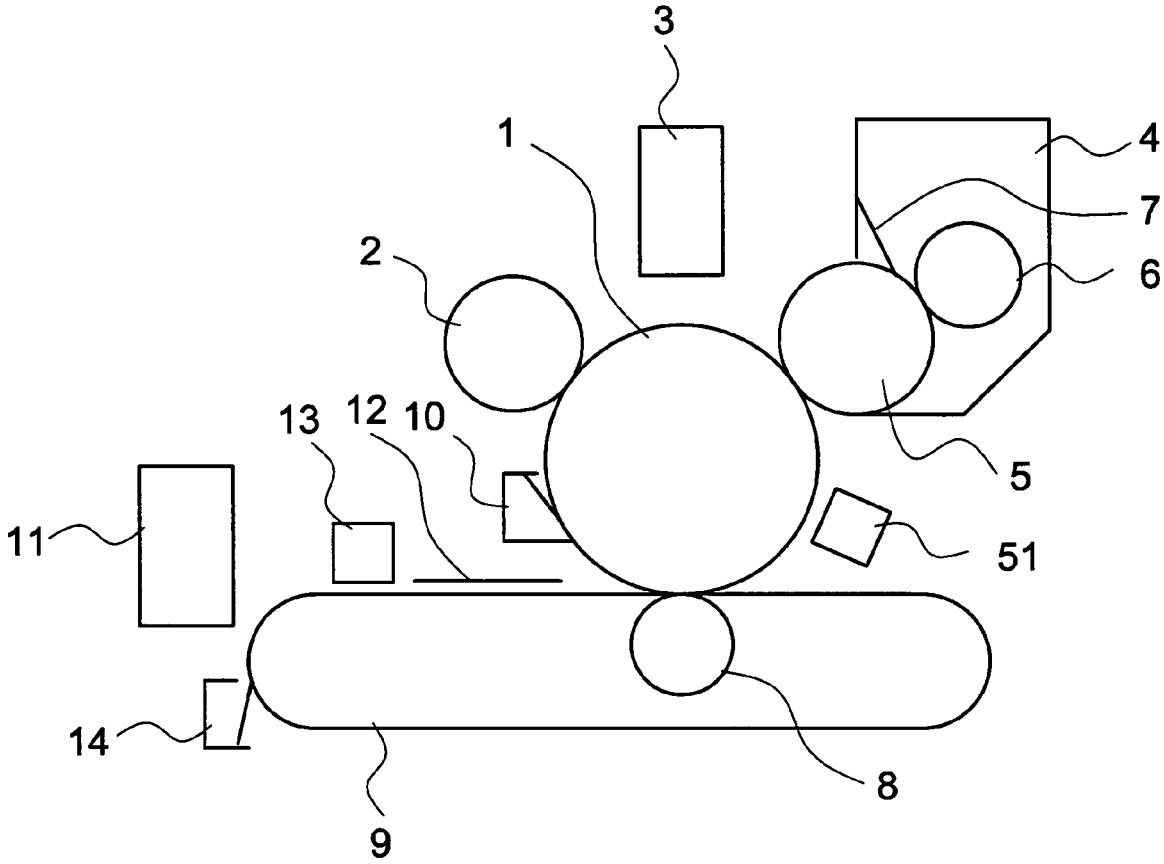
FIG. 16 is a diagram of an image forming apparatus according to embodiment 2 of the present invention.

FIG. 16 is a diagram of an image forming apparatus according to embodiment 2 of this invention. Since the electronic contrast voltage value is set into a range in which the fog value photographic printer as an image forming apparatus, the present embodiment provides the same serial numbers and omits the specification when it enjoys the same structure as that of embodiment 1. In the 2nd embodiment, potential sensor 51 is set in the positions where it connects with developing roller and transfer belt 9 by facing to the photosensitive drum 1. The potential sensor 51 is a non-contact type surface potential sensor. In addition, the printing process of the image forming apparatus of the present embodiment is nearly the same as that of embodiment 2.

Figure 17:
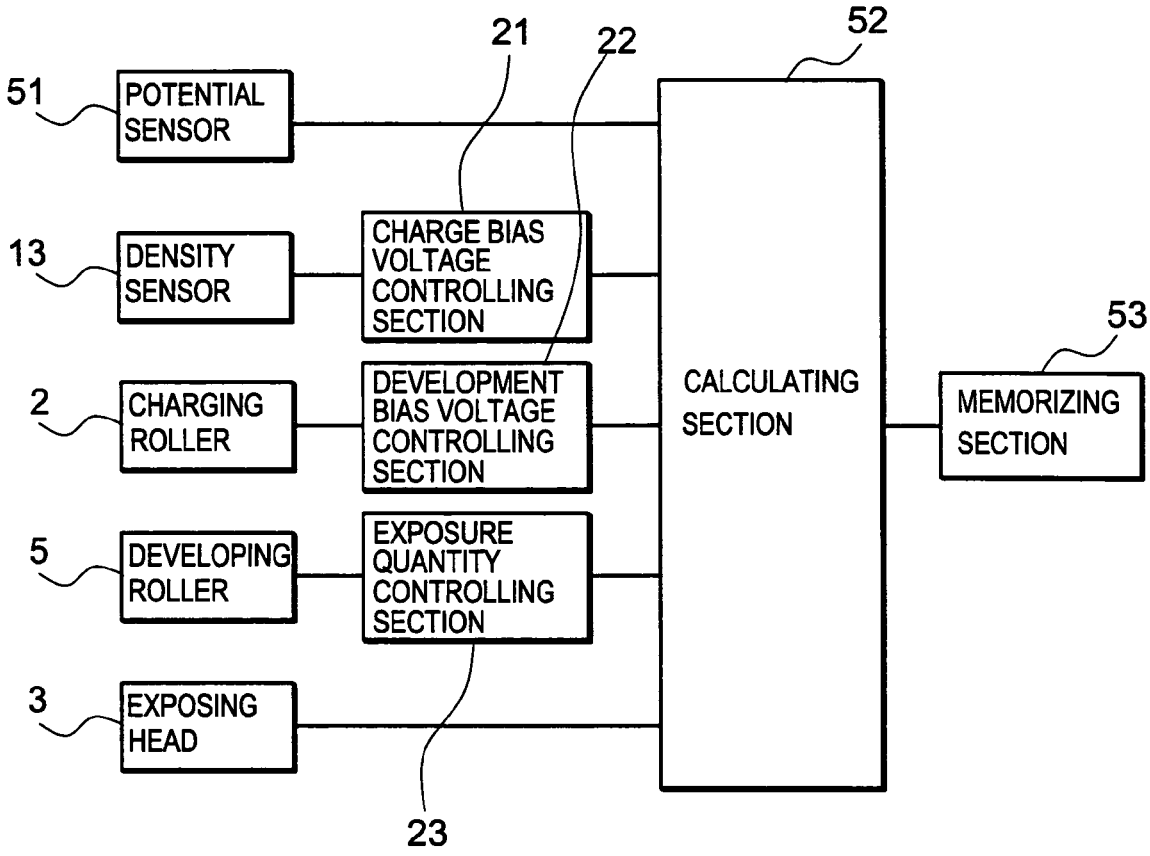
FIG. 17 is a control block diagram of an image forming apparatus according to embodiment 2 of the present invention.

FIG. 17 is a control block diagram of an image forming apparatus according to embodiment 2 of this invention. The charge bias voltage controlling section is connected to charging roller 2 and provides it with the charge bias voltage set by calculating section 52. The development bias voltage controlling section 22 is connected to developing roller 5 and provides it with the development bias voltage set by calculating section 52. The exposure quantity controlling section is connected to exposure head 3 and provides it with the driving current set by calculating section 52. The density sensor 13 reads the toner image on transfer belt and the detected output value is the density calculated by calculating section 52. The potential sensor 51 reads the photosensitive drum charge potential and toner layer potential formed on the photosensitive drum and the detected output value is the voltage value calculated by calculating section 52. Memorizing section is connected to calculating section 52.

Figure 18:
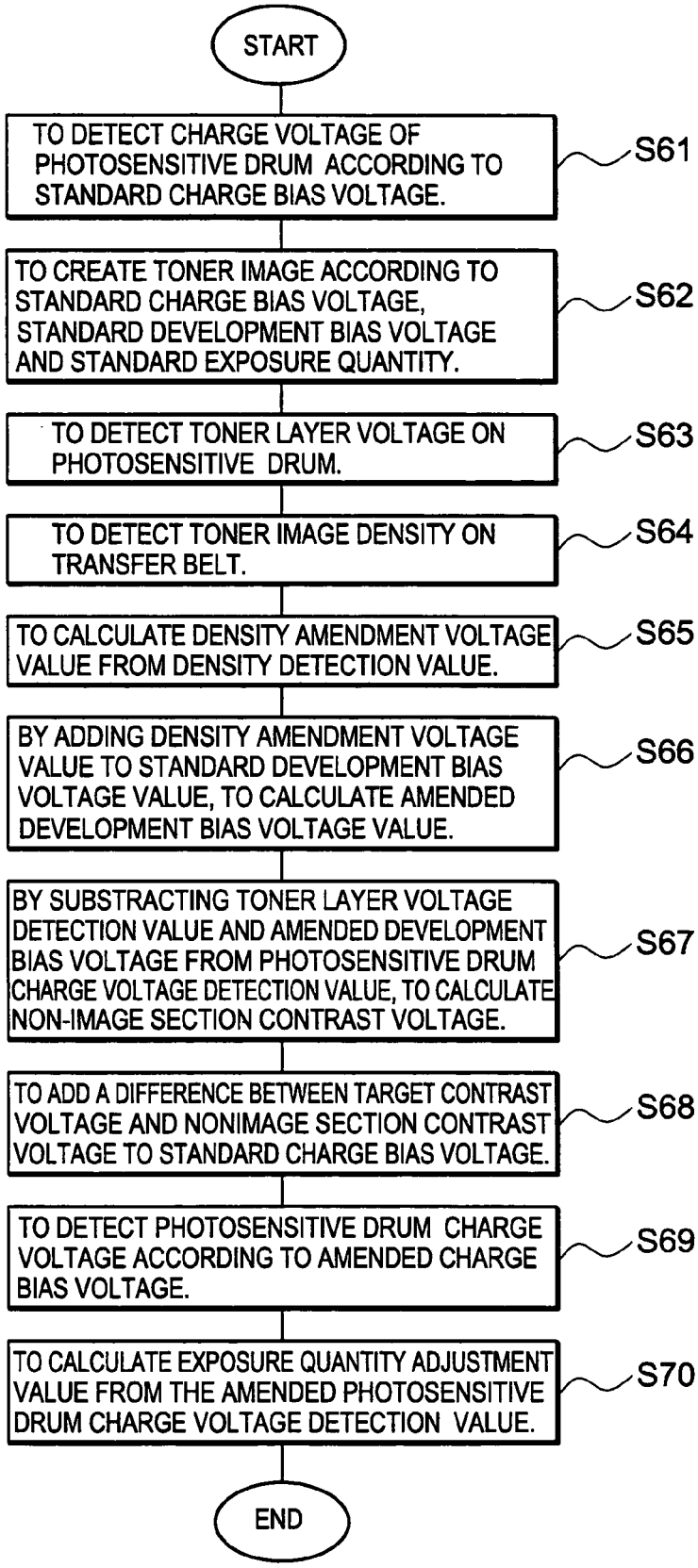
FIG. 18 is a flowchart of density amendment according to embodiment 2 of the present invention.

FIG. 18 is a flowchart of density amendment according to embodiment 2 of this invention. During the density amendment, firstly the standard charge bias voltage memorized by memorizing section 53 is read and supply charging roller voltage charge the surface of the photosensitive drum. The photosensitive drum charge potential is detected by potential sensor 51. (Step S61). For example, the standard charge bias voltage is −1000V; the detected photosensitive drum charge voltage is −520V. The detected photosensitive drum charge potential is memorized into memorizing section 53.

Secondly, the standard exposure quantity memorized in memorizing section 53 is read. The driving current corresponding to standard exposure quantity is provided to the exposure head 3 and the electrostatic latent image pattern is formed. Furthermore, the standard development bias voltage value memorized in memorizing section 53 is read and provided to developing roller 5 which develops the electrostatic latent image pattern and changes into toner image (Step S 62). If the driving current of standard exposure quantity is 3 mA, the standard development bias voltage is −300V. It is hoped that the electrostatic latent image pattern can be used in detecting toner layer potential and density. For example, the patch patterns with area rate of 100%, 70% and 30% are formed corresponding to the positions of potential sensor 51 and density sensor 13.

Later, the surface voltage of amended pattern with an area rate of 100% of toner image formed on photosensitive drum is detected by potential sensor 51 and calculated in calculating section 52 leading to the detection of toner layer potential (Step S 63). The detected toner layer potential is memorized into memorizing section 53. In this case the detected toner layer potential is −80V.

Then, the toner image formed on the photosensitive drum is directly transferred on transfer belt. Later, the patch pattern moves below the density sensor 13, the reflectivity of the patch pattern is read by a diode through the rolling of transfer belt 9 that is used for calculation in the calculating section 52 (step 64). The toner transferred on to the transfer belt 9 by the density sensor 13 is wiped by a cleaning blade and is recycled into toner cartridges that do not display a pattern.

After the calculation of density, the difference between density value and target value detected by calculating section 52 is calculated. When a linear relation is kept between development bias voltage value and density, the amended voltage value of development bias voltage corresponding to amended difference density is calculated according to the amended coefficient memorized in memorization section 53 in advance (Step 65). In terms of the charging characteristics of developing roller material and toner in the present embodiment, the amended coefficient is 0.3 corresponding to the OD changing quantity when the changing quantity of development bias voltage is 100V. For example, when the detected density OD is 1.8 and the target density OD is 1.5, the development bias voltage proves to be good after the decreasing of 100V. In this case, the development bias amended voltage value corresponding to density is +100V.

As referred above, by adding the amended value of standard development bias voltage to development bias voltage value according to the density calculated above to calculate the amended development bias voltage (step 66). Since the development bias density amendment voltage value according to the density is +100V, standard development bias voltage value is −300V, the amended development bias voltage is +100+(−300)=−200V.

After the calculation of amended development bias voltage, by subtracting the detected toner layer potential value and the amended development bias voltage memorized in memorizing section 53 from the detected photosensitive drum charge potential value memorized in the same memorizing section to calculate the non-image section contrast voltage (step S67). As referred above, since the detected photosensitive drum charge potential value is −520V, the detected toner layer potential value is −80V and the amended development bias voltage is −200V, the non-image section contrast voltage is |−200+(−80)−(−520)|=240V. Since the non-image section contrast voltage is above 180V, the fog value above 0.5 is viewed as within the poor range according to FIG. 15.

After the calculation of non-image section contrast voltage, by adding standard charge bias voltage to the difference between the target non-image section contrast voltage and the calculated non-image section contrast voltage value memorized in memorizing section 53 in advance (step S68). The target contrast voltage is set into the range that makes the fog value be under 0.5. For example, the target non-image section contrast voltage is set as 130V, the difference between non-image section contrast voltage and it is calculated by subtracting the target non-image section contrast voltage from the non-image section contrast voltage, that is, since 240−130 =110V, the amended charge bias voltage is −1000+110=−890V by adding standard charge bias voltage to it.

Later, the amended charge bias voltage is provided to charging roller that charges photosensitive drum 1. Furthermore, the current charge potential is detected by potential sensor 51 (step S69). In this case, the detected photosensitive drum charge potential is −410V. As referred above, since the amended development bias voltage is −200V the detected toner layer potential value is −80V and, the non-image section contrast voltage is |−200+(−80)−(−410)|=130V. The fog value is below 0.5 according to FIG. 15.

After the detection of amended photosensitive drum charge potential, the exposure quantity adjustment value is calculated with the detected charge voltage value (step S70). The exposure quantity adjustment coefficient is memorized in memorizing section in advance. As showed in FIG. 13, the photosensitive drum charge potential −500 is regarded as standard in the present embodiment; the exposure quantity adjustment coefficient is 0.003 corresponding to the changing quantity of every 1V charge voltage. Since the detected photosensitive drum charge potential value is −410 V, the exposure quantity is 1−(−410−(−500)*0.003=0.73. The desired image density can be gained through density amendment after the adjustment of latent potential depth.

According to above processing, the bias control can be completed through density amendment in the present embodiment. According to the density amendment of the present embodiment, since the non-image section contrast voltage is adjusted after the direct detection of photosensitive drum charge potential and toner layer potential value, the non-image section contrast voltage is usually within the predetermined range under the circumstances of change of development bias voltage, toner layer potential and operation environments. Therefore, good print quality with fog value below 0.5 can be gained under all environment levels. If the fog value below 0.5 is regarded as target, the setting value of non-image section contrast voltage is good as long as it being within the range of 100V and 180V. (See FIG. 15). In addition, for the purpose of setting the non-image section contrast voltage, when the charge bias voltage is changed, a certain degree of density could be reached since the exposure quantity is adjusted according to that changing quantity and the development contrast voltage is kept as the amended density value.

The density amendment as referred above can be performed when the power of the apparatus is turned on, print count is defined into a certain amount or the environment level is changed.

Certainly, the value showed in the present embodiment is only one example that meets the conditions for characteristics of usage craft materials and craftwork speed. The target value is set into most suitable one that turned out to be good. Therefore, the decision range of the quality for non-image section contrast voltage can be made according to the corresponding required quality level.

Moreover, the present invention can be applied in other industries. That is:

In embodiment 1 and 2 referred above, although only the printer is used to specify the present invention, it also can be applied to the image forming apparatus of facsimile machine, copier or MPF with more than two functions (Multi-Function Product).

Secondly, the present invention not only can be applied in monochrome printer with one developing machine, but color printer with four developing machines that transfers with one cycle, let alone color printer with four cycles that forms colorful images transferred one by one for four times repeatedly with middle transfer belt.

In addition, although one example applied in printers with one component contact developing manner is specified, the present invention can also be applied in printers with one component non-contact developing manner or with two component contact developing manner.

In embodiment 2, though the example concerning the detection of toner layer potential on photosensitive drum is specified, the potential sensor can also be set on the opposite position of transfer belt to detect and control the toner layer potential after transferring. In addition, the potential sensor can also be set on the opposite position of developing roller to detect and control the toner layer potential on the developing roller.

Furthermore, the current detecting circuit, as a replacement for potential sensor, can be used to detect the current on the developing roller. The detected current value can be applied in calculating the toner layer and photosensitive drum charge potential that can be used in controlling process.

What is claimed is:

1. An image forming apparatus, comprising:

an image carrier;

a charging section which is provided with a charge voltage and charges surface of said image carrier;

an exposing section for forming an electrostatic latent image on the surface of said image carrier;

a developing section which is provided with a development voltage and makes developer adhere to said electrostatic latent image formed on said image carrier so as to form a visible image;

a transferring section to transfer said visible image onto a transfer member;

a density detecting section to detect a density of said visible image on said transfer member;

a development voltage setting section to set a development voltage to be provided to said developing section based on said density detected by said density detecting section;

a charge voltage setting section to set a difference between said charge voltage provided to said charging section and said development voltage set by said development voltage setting section into a value in a predetermined range; and an exposure quantity setting section to set an appointed exposure quantity with respect to said charge voltage.

2. The image forming apparatus according to claim 1, further comprising:

an environment information detecting section to detect environment information in the image forming apparatus; and an environment table to memorize voltage according to said detected environment information, wherein according to said detected environment information, a difference between said charge voltage provided to said charging section and said development voltage set by said development voltage setting section is set into a value in predetermined range.

3. The image forming apparatus according to claim 2, wherein said environment information is either of temperature and humidity in the image forming apparatus.

4. The image forming apparatus according to claim 3, further comprising:

a print information detecting section to detect print information; and a temporality setting table to memorize voltage according to said detected print information, wherein according to said detected print information, a difference between said charge voltage provided to said charging section and said development voltage set by said development voltage setting section is set into a value in predetermined range.

5. The image forming apparatus according to claim 4, wherein said print information is the number of print sheets.

6. The image forming apparatus according to claim 2, further comprising:

a print information detecting section to detect print information; and a temporality setting table to memorize voltage according to said detected print information, wherein according to said detected print information, a difference between said charge voltage provided to said charging section and said development voltage set by said development voltage setting section is set into a value in predetermined range.

7. The image forming apparatus according to claim 6, wherein said print information is the number of print sheets.

8. The image forming apparatus according to claim 1, further comprising:

a print information detecting section to detect print information; and a temporality setting table to memorize voltage according to said detected print information, wherein according to said detected print information, a difference between said charge voltage provided to said charging section and said development voltage set by said development voltage setting section is set into a value in predetermined range.

9. The image forming apparatus according to claim 8, wherein said print information is the number of print sheets.

10. An image forming apparatus, comprising:

an image carrier;

a charging section which is provided with a charge voltage and charges surface of said image carrier;

a exposing section for forming an electrostatic latent image on the surface of said image carrier;

a developing section which is provided with a development voltage and makes developer adhere to said electrostatic latent image formed on said image carrier so as to form a visible image;

a transferring section to transfer said visible image onto a transfer member;

a density detecting section to detect a density of said visible image on said transfer member;

a development voltage setting section to set a development voltage to be provided to said developing section based on said density detected by said density detecting section;

a potential detecting section to detect surface voltage of said visible image;

a charge voltage setting section to set a difference between said charge voltage provided to said charging section and said development voltage set by said development voltage setting section into a value in a predetermined range on the basis of said surface voltage detected by said potential detecting section; and an exposure quantity setting section to set an appointed exposure quantity with respect to said charge voltage.

11. The image forming apparatus according to claim 10, wherein said potential detecting section is to detect a visible image potential on said image carrier.

12. The image forming apparatus according to claim 11, wherein said potential detecting section is a potential sensor.

13. The image forming apparatus according to claim 10, wherein said potential detecting section is to detect a visible image potential on said transfer member.

14. The image forming apparatus according to claim 13, wherein said potential detecting section is a potential sensor.

15. The image forming apparatus according to claim 10, wherein said potential detecting section is to detect a visible image potential on said developing section.

16. The image forming apparatus according to claim 15, wherein said potential detecting section is a potential sensor.

17. The image forming apparatus according to claim 15, wherein said potential detecting section is a development electric current detecting circuit.

18. The image forming apparatus according to claim 10, wherein said potential detecting section is a potential sensor.

* * * * *